US006390882B1

(12) United States Patent
Chang

(10) Patent No.: US 6,390,882 B1
(45) Date of Patent: May 21, 2002

(54) DECORATIVE-ARTICLE STRUCTURE MADE FROM WINDING METALLIC WIRES AND BEING ROTATABLE UNDER SOLAR ENERGY

(76) Inventor: Michael Chang, 9th Fl. 285, Nanking E. Rd., Sec. 3, Taipei (TW)

( * ) Notice: Subject to any disclaimer, the term of this patent is extended or adjusted under 35 U.S.C. 154(b) by 0 days.

(21) Appl. No.: 09/893,899

(22) Filed: Jun. 29, 2001

(51) Int. Cl.[7] ..... A63H 3/00; A63H 13/00

(52) U.S. Cl. ..... 446/268; 446/385; 446/374; 446/330; 446/352; 40/411; 40/421; 40/539

(58) Field of Search ..... 446/385, 374, 446/175, 391, 330, 338, 352, 353, 484, 268; 40/411, 421, 465, 466, 539, 540

(56) References Cited

U.S. PATENT DOCUMENTS 4,702,140 A * 10/1987 Goldfarb ..... 446/303
5,145,442 A * 9/1992 Zan ..... 446/163
5,894,898 A * 4/1999 Catto ..... 180/181
6,010,173 A * 1/2000 Chyan-Luen ..... 296/78.1

* cited by examiner

*Primary Examiner*—Jacob K. Ackun
*Assistant Examiner*—Bena B. Miller
(74) *Attorney, Agent, or Firm*—Dennison, Schultz & Dougherty

(57) ABSTRACT

A decorative-article structure made from winding metallic wires and being rotatable under solar energy, it includes a specifically designed main body formed by winding metallic wires, and includes a solar energy board and a motor at proper positions on the main body, a decorative housing covers the motor, the housing is glued with a patterned sticker formed by laser. When the solar energy board absorbs light source and supplies power for the motor, the motor will drive housing to rotate, the laser formed sticker on the top of the housing will reflect light to generate various colors, the metallic main body will generate vibrations during activating of the motor, and create the feature of extremely interesting visual sensation.

2 Claims, 4 Drawing Sheets

DECORATIVE-ARTICLE STRUCTURE MADE FROM WINDING METALLIC WIRES AND BEING ROTATABLE UNDER SOLAR ENERGY

BACKGROUND OF THE INVENTION

1. Field of the invention

The present invention is related to a decorative-article structure made from winding metallic wires and being rotatable under solar energy, using light source to supply power without adding any other extra power can present animated feeling, and especially to a decorative-article structure suitable to apply on decorative-article structures for displaying and enjoying.

2. Description of the Prior Art

Generally speaking, for increasing the quality and fun of life, the most popular ways include feeding fish, birds and planting flowers etc.; but fish, birds and flowers are all live things, they die easily without taking good care. In order not to endanger these animal and plant lives, there are many designs of decorations or displaying stuffs to imitate these living creatures. For example, a pneumatic decorative article includes:

a main body which is a transparent hollow cylinder, the bottom thereof is sealed with a bottom lid to contain liquid therein, the bottom lid is provided on the rim thereof with a protruding ring, an axle post is built in the center thereof, and two or more air outlets are provided on the protruding ring, an annular cap is connected with the bottom of the bottom lid, a pre-built annular groove of the annular cap forms an air passage with the air outlets, the annular groove is communicated with an air tenon for leading in air; a rotary disk which is provided with an axle hole at the center thereof for fitting in of the axle post, the rim of the rotary disk with a diameter in correspondence with that of the protruding ring is slantly provided with cut and bent wing slices, and color layers with different colors are provided juxtaposed with one another on the rotary disk's surface; a base which bears the bottom of the main body, and is provided with an illuminating portion and an air supplying portion, the light beams of a projecting lamp in the illuminating portion penetrates the bottom lid and the color layers, and the air supplying portion is connected to the air tenon by means of an air dispatch tube, so that air can be supplied for the annular groove and discharged out of the air outlet.

By touching of bead-like air bubbles discharged out of the air outlet to the wing slices, a sideward pushing force will be generated and make the rotary disk rotate, the various color layers on the top of the rotary disk will be penetrated by the light sequentially, besides, it will cause various changes on the light shadows due to interaction of the light, air bubbles and color layers onto liquid.

However, although this kind of decoration articles can generate various changes of light shadows and air bubbles, there are too many composing elements, and they are too complicated structurally to be desired.

Accordingly, it is the goal of the present invention to get rid of the defects resided in the above mentioned publicly used conventional structures and offer a simple and fine structure of a decorative article with animating feeling made from winding metallic wires and being rotatable under solar energy to provide a special visual effect.

SUMMARY OF THE INVENTION

The prime object of the present invention is to provide an extremely animating and interesting decorative-article structure made from winding metallic wires and being rotatable under solar energy, which can also generate various visual effects.

The secondary object of the present invention is to provide a decorative-article structure made from winding metallic wires and being rotatable under solar energy, the structure not only has a rotating function but also has a vibrating function.

To obtain the abovementioned objects, the present invention includes a specifically designed main body made from winding metallic wires, a solar energy board and a motor are provided at proper positions on the main body, a decorative housing covers the motor, a patterned sticker formed by laser is stuck to the housing. When a solar-energy board absorbs light source and supplies power for the motor, the motor will drive the housing to rotate, the laser sticker on the top of the housing will reflect light source and generate varied colors, the metallic main body will generate vibrations during activating of the motor and create the feature of extremely interesting visual sensation.

The present invention will be apparent in its detailed structure, applied principles, functions and effects after reading the detailed description of the preferred embodiment thereof in reference to the accompanying drawings.

DETAILED DESCRIPTION OF THE PREFERRED EMBODIMENT

Figure 1:
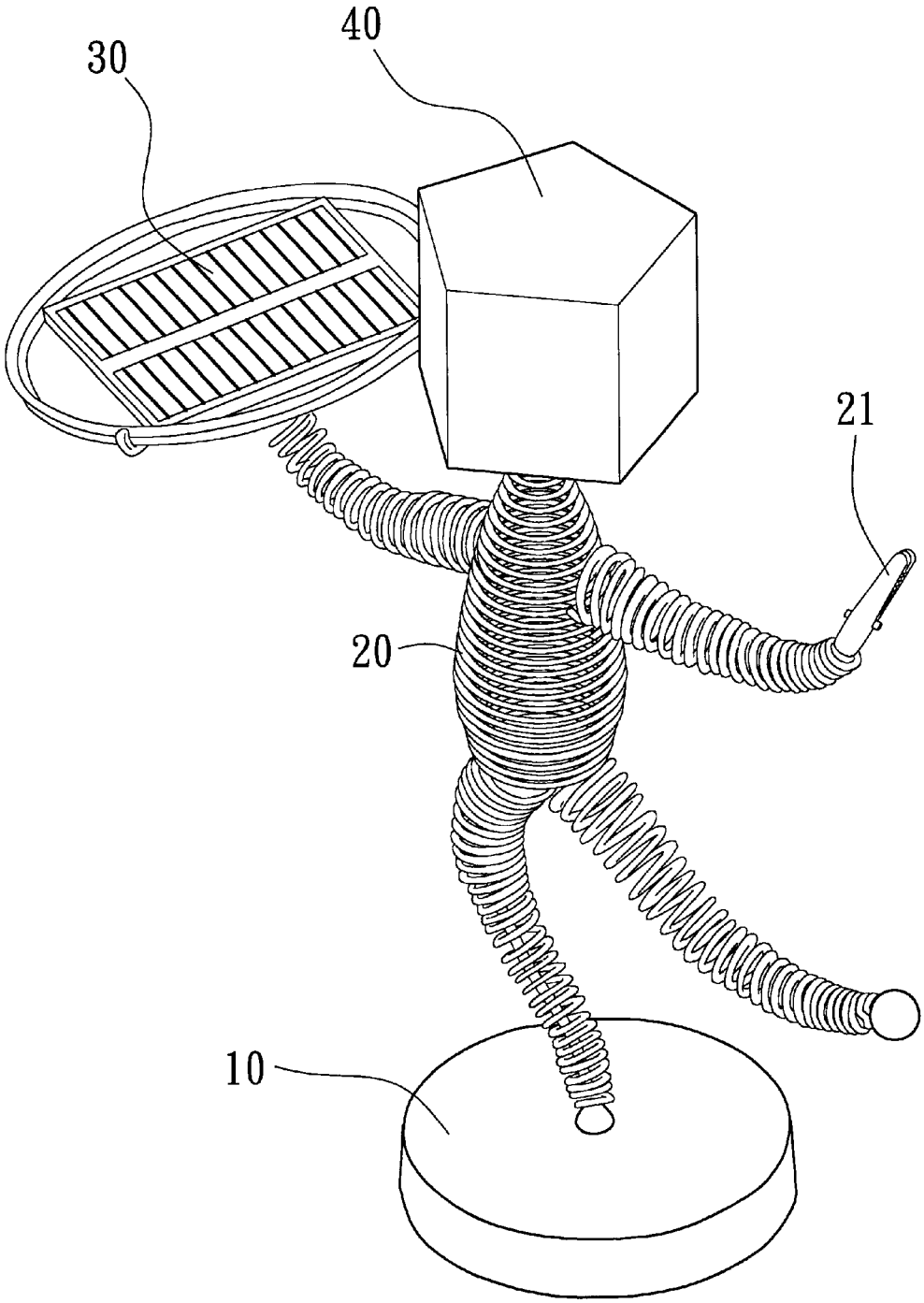
FIG. 1 is a perspective view showing the appearance of an embodiment of the present invention.

Referring to FIG. 1, the present invention includes a specifically designed main body 20 mainly made from plural rings formed by winding of metallic wires. In this preferred embodiment, the main body 20 has a human figure having four limbs. One lower limb of the main body is fixed on a bottom plate 10, so that the main body 20 can stand up straight. The other lower limb and 2 and the two upper limbs are bent upwardly, and one of the upper limbs is connected with a clip 21 which can hold name cards, a chit book and so on, the other upper limb is fixedly mounted with a solar energy board 30. A housing 40 is used to cover the head of the main body 20.

Figure 2:
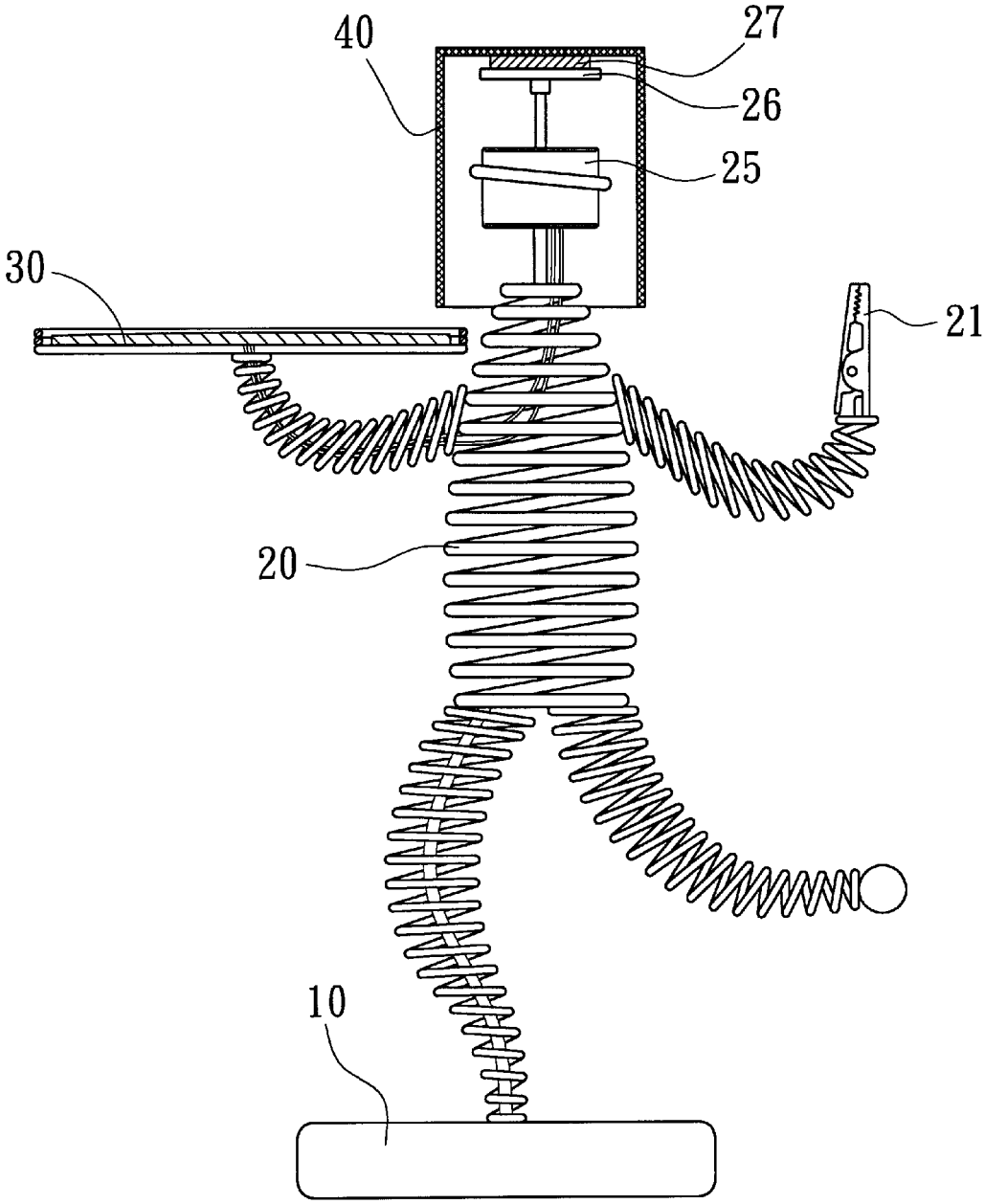
FIG. 2 is a sectional view of the embodiment of the present invention.
Figure 3:
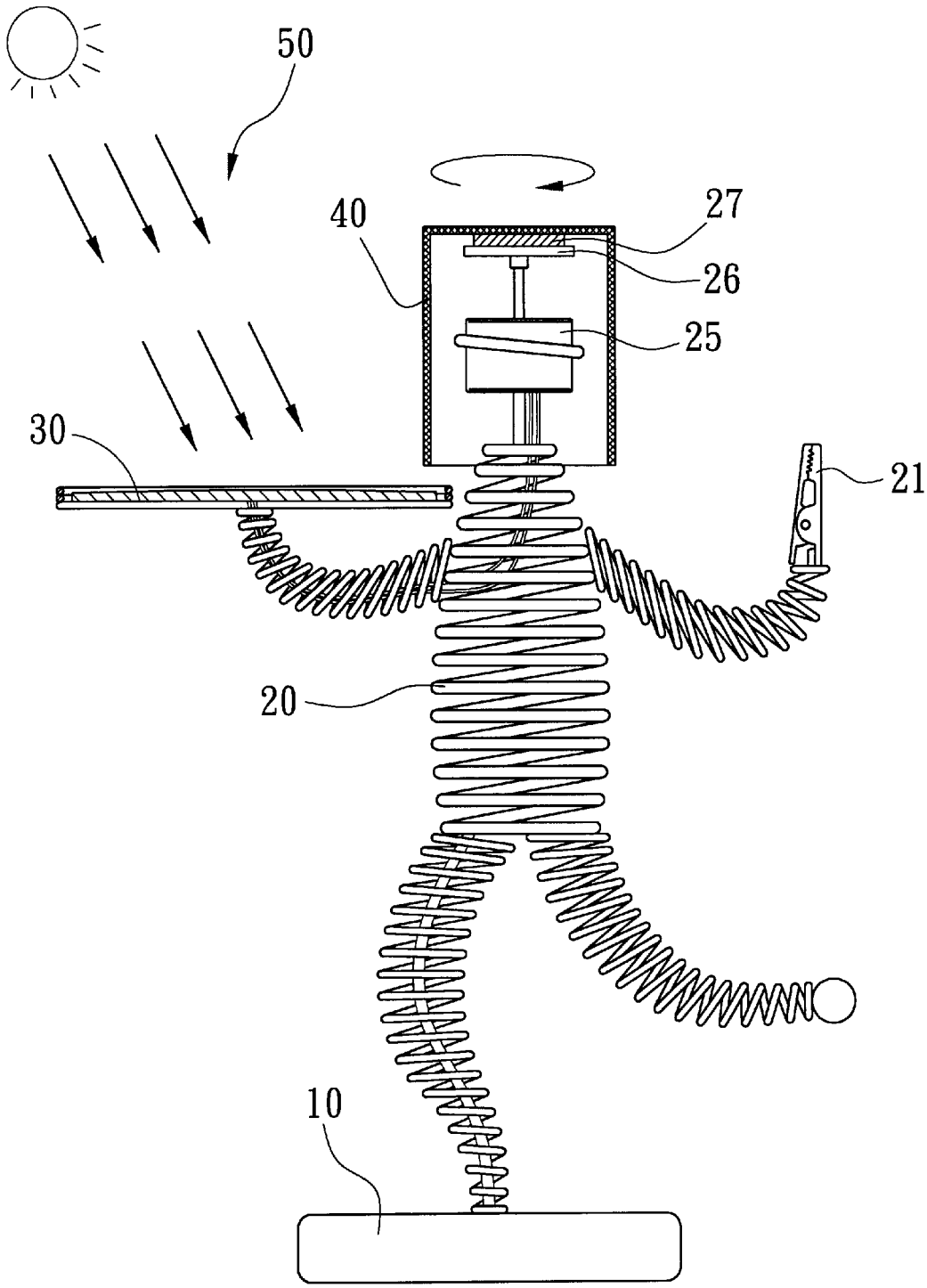
FIG. 3 is an action schematic view showing the embodiment of the present invention is irradiated by light.

Referring to FIG. 2, the head of the main body 20 is equipped with a motor 25, the power line of the motor 25 is connecting to the solar energy board 30, an axle plate 26 is slipped over the top end of the motor axle, the axle plate 26 is integrally connected with the housing 40 by means of a connecting piece 27 (double-faced sticker). Putting the present invention under a light source 50, the solar energy board 30 will absorb the light and turn it into power and supply the necessary energy for the motor 25. When the motor 25 is activated, the motor axle will drive the axle plate 26 to rotate the housing 40 which is connected therewith by means, of the conjunction piece 27 (double-faced sticker), the decorative article thereby has a rotating function. And the housing 40 can be glued with a patterned sticker formed by laser, when the housing 40 rotates, the patterned sticker can reflect light and generate various colors.

Figure 4:
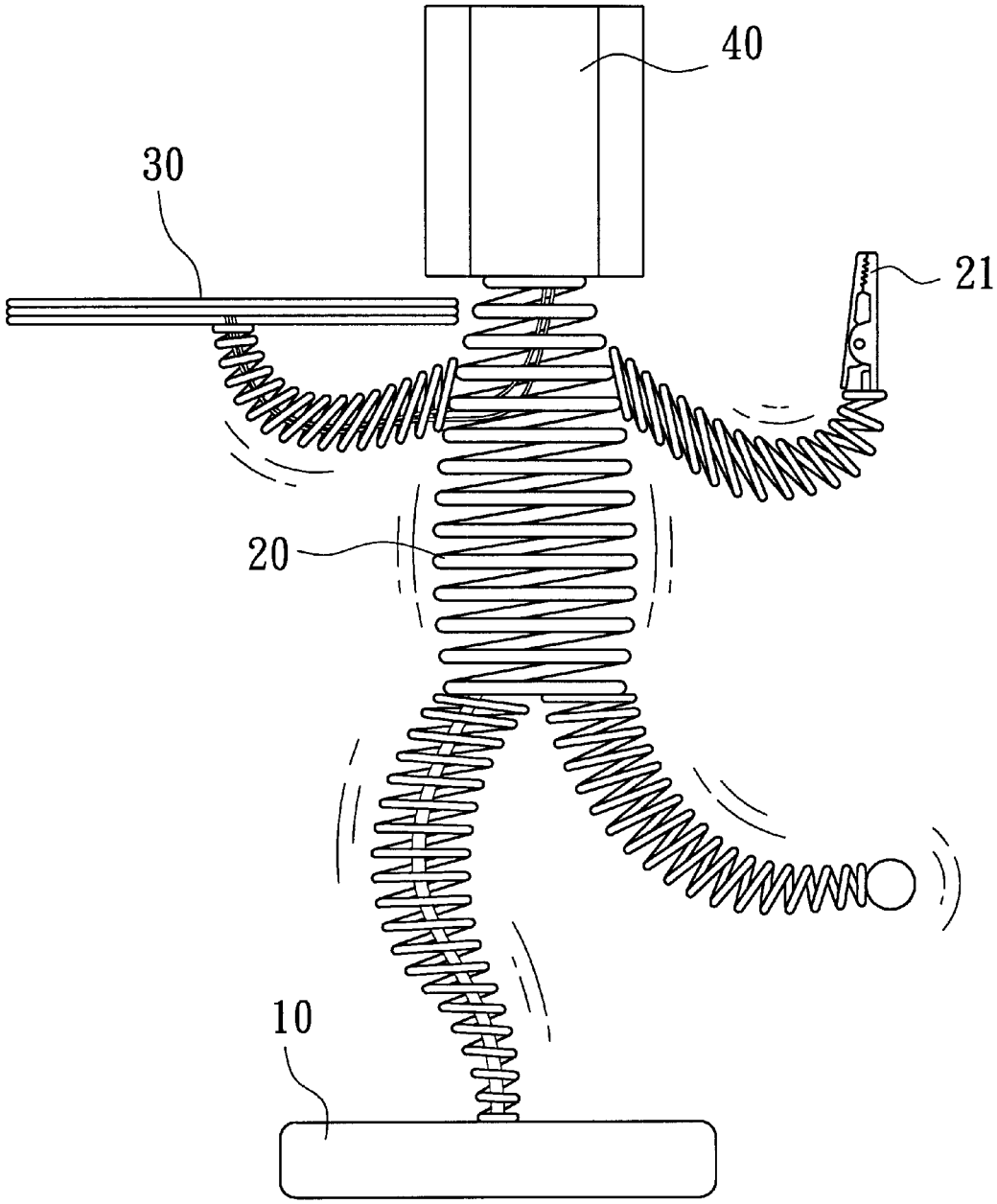
FIG. 4 is a schematic view showing the vibrated appearance of the embodiment of the present invention when being irradiated by the light.

Moreover, since the main body 20 is formed by winding of metallic wires and its two upward upper limbs and one lower limb being bent are hung in the air, when the motor 25 is activated, the rotating force of the motor 25 will cause vibration of the main body 20 (as shown in FIG. 4), this can make the main body 20 in the human figure with four-limbs rotate with the motor 25 and sway up and down as well as sideways, the decorative article will similarly give a visual effect of waving hands and stamping feet.

The main body 20 made from winding metallic wires can also be moderated to have other modeling, for example, a figure on a bicycle, a wind mill or a flying object and so on, so as to get variant designs of decorative articles.

In conclusion, according to the disclosure in the above statement, the present invention can surely obtain the expected objects to supply extremely animating decorative articles made from winding metallic wires and being rotatable under solar energy with simple and fine composing elements, being convenient for assembling, being able to upgrade the appreciation value, and being full of interesting and animating feeling. The structure stated above hence has novelty and practicality.

The above statement is only to illustrate a preferred embodiment of the present invention, and not for giving any limitation to the scope of the present invention. It will be apparent to those skilled in this art that various equivalent modifications or changes can be made to the elements of the present invention without departing from the spirit, and they shall fall within the scope of present invention.

What is claimed is:

1. A decorative-article structure made from winding metallic wires and being rotatable under solar energy, said structure is comprised of:

a specifically designed main body formed by winding metallic wires;

a solar energy board provided on said main body; and a motor provided on said main body too, a decorative housing covers said motor;

when said solar energy board absorbs light source to supply power for said motor, said motor drives said housing to rotate, said metallic main body generates vibration during activating of said motor to create a feature of extremely interesting visual sensation.

2. A decorative-article structure made from winding metallic wires and being rotatable under solar energy as claimed in claim 1, wherein, said main body is provided with thereon with a clip.

* * * * *